US009260934B2

(12) United States Patent
Godfrey et al.

(10) Patent No.: US 9,260,934 B2
(45) Date of Patent: Feb. 16, 2016

(54) REMOTE OPERATION OF A ROTATING CONTROL DEVICE BEARING CLAMP

(75) Inventors: Craig W. Godfrey, Dallas, TX (US); Peter Antonenko, Kuala Lumpur (MY); Neal G. Skinner, Lewisville, TX (US); Fredrick D. Curtis, Houston, TX (US); Derrick W. Lewis, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 811 days.

(21) Appl. No.: 13/293,995

(22) Filed: Nov. 10, 2011

(65) Prior Publication Data

US 2012/0125598 A1 May 24, 2012

(51) Int. Cl.
*E21B 33/038* (2006.01)
*E21B 33/08* (2006.01)

(52) U.S. Cl.
CPC ..... *E21B 33/085* (2013.01)

(58) Field of Classification Search
CPC ... E21B 33/038; E21B 33/085; E21B 17/085; E21B 33/043; F16L 37/002
USPC ..... 166/85.1, 85.4, 379
See application file for complete search history.

(56) References Cited

U.S. PATENT DOCUMENTS

| | | | | |
|---|---|---|---|---|
| 5,651 A | | 6/1848 | West et al. | |
| 2,326,941 A | | 8/1943 | Heitner | |
| 2,684,166 A | | 7/1954 | Jarnett | |
| 3,387,851 A | | 6/1968 | Cugini | |
| 3,472,518 A | | 10/1969 | Harlan | |
| 3,477,744 A | * | 11/1969 | Brown | 285/18 |
| 3,621,912 A | | 11/1971 | Wooddy, Jr. | |
| 3,956,987 A | | 5/1976 | Alix | |
| 4,033,701 A | | 7/1977 | Labyer et al. | |
| 4,098,341 A | | 7/1978 | Lewis | |
| 4,154,448 A | | 5/1979 | Biffle | |
| 4,185,856 A | * | 1/1980 | McCaskill | 285/18 |
| 4,304,310 A | | 12/1981 | Garrett | |
| 4,312,404 A | | 1/1982 | Morrow | |
| 4,361,185 A | | 11/1982 | Biffle | |

(Continued)

FOREIGN PATENT DOCUMENTS

| | | |
|---|---|---|
| EP | 2050924 A2 | 4/2009 |
| EP | 2208855 A2 | 7/2010 |

(Continued)

OTHER PUBLICATIONS

Halliburton Drawing No. 12MLE1106, Size D, Rev. A, dated Jul. 27, 2000, 1 page.

(Continued)

*Primary Examiner* — Blake Michener
*Assistant Examiner* — Kipp Wallace
(74) *Attorney, Agent, or Firm* — Chamberlain Hrdlicka

(57) ABSTRACT

A rotating control device can include a housing assembly, a body and a clamp device which releasably secures the housing assembly to the body. The clamp device can include a piston which radially displaces a clamp section. A well system can include a rotating control device which includes at least one seal which seals off an annulus between a body of the rotating control device and a tubular string which extends longitudinally through the rotating control device. The rotating control device can also include a piston which displaces longitudinally and selectively clamps and unclamps a housing assembly to the body.

21 Claims, 9 Drawing Sheets

(56) References Cited

U.S. PATENT DOCUMENTS

| | | | | |
|---|---|---|---|---|
| 4,367,795 | A | 1/1983 | Biffle | |
| 4,441,551 | A | 4/1984 | Biffle | |
| 4,456,062 | A | 6/1984 | Roche et al. | |
| 4,529,210 | A | 7/1985 | Biffle | |
| 4,531,580 | A * | 7/1985 | Jones | 166/84.3 |
| 4,626,135 | A | 12/1986 | Roche | |
| 4,813,495 | A | 3/1989 | Leach | |
| 5,085,129 | A | 2/1992 | Dugan | |
| 5,166,650 | A | 11/1992 | Simmons et al. | |
| 5,178,215 | A | 1/1993 | Yenulis et al. | |
| 5,224,557 | A | 7/1993 | Yenulis et al. | |
| 5,277,249 | A | 1/1994 | Yenulis et al. | |
| 5,279,365 | A | 1/1994 | Yenulis et al. | |
| 5,647,444 | A | 7/1997 | Williams | |
| 5,662,181 | A | 9/1997 | Williams et al. | |
| 6,109,348 | A | 8/2000 | Caraway | |
| 6,129,152 | A | 10/2000 | Hosie et al. | |
| 6,138,774 | A | 10/2000 | Bourgoyne, Jr. et al. | |
| 6,230,824 | B1 | 5/2001 | Peterman et al. | |
| 6,244,359 | B1 | 6/2001 | Bridges et al. | |
| 6,263,982 | B1 | 7/2001 | Hannegan et al. | |
| 6,325,159 | B1 | 12/2001 | Peterman et al. | |
| 6,470,975 | B1 | 10/2002 | Bourgoyne et al. | |
| 6,547,002 | B1 | 4/2003 | Bailey et al. | |
| 6,554,016 | B2 | 4/2003 | Kinder | |
| 6,702,012 | B2 | 3/2004 | Bailey et al. | |
| 6,732,804 | B2 | 5/2004 | Hosie et al. | |
| 6,749,172 | B2 | 6/2004 | Kinder | |
| 6,913,092 | B2 | 7/2005 | Bourgoyne et al. | |
| 7,004,444 | B2 | 2/2006 | Kinder | |
| 7,007,913 | B2 | 3/2006 | Kinder | |
| 7,040,394 | B2 | 5/2006 | Bailey et al. | |
| 7,080,685 | B2 * | 7/2006 | Bailey et al. | 166/84.4 |
| 7,159,669 | B2 | 1/2007 | Bourgoyne et al. | |
| 7,237,623 | B2 | 7/2007 | Hannegan | |
| 7,258,171 | B2 | 8/2007 | Bourgoyne et al. | |
| 7,448,454 | B2 | 11/2008 | Bourgoyne et al. | |
| 7,472,870 | B2 | 1/2009 | Zagorski et al. | |
| 7,487,837 | B2 | 2/2009 | Bailey et al. | |
| 7,665,773 | B2 | 2/2010 | Jones et al. | |
| 7,699,109 | B2 | 4/2010 | May et al. | |
| 7,779,903 | B2 | 8/2010 | Bailey et al. | |
| 7,836,946 | B2 | 11/2010 | Bailey et al. | |
| 7,926,560 | B2 | 4/2011 | Bailey et al. | |
| 7,926,593 | B2 | 4/2011 | Bailey et al. | |
| 8,028,750 | B2 | 10/2011 | Hughes et al. | |
| 8,033,335 | B2 | 10/2011 | Orbell et al. | |
| 8,739,863 | B2 | 6/2014 | Linde et al. | |
| 8,757,274 | B2 | 6/2014 | Skinner et al. | |
| 2004/0009033 | A1 | 1/2004 | Rieber et al. | |
| 2006/0102387 | A1 | 5/2006 | Bourgoyne et al. | |
| 2006/0108119 | A1 | 5/2006 | Bailey et al. | |
| 2006/0144622 | A1 | 7/2006 | Bailey et al. | |
| 2008/0017388 | A1 | 1/2008 | Kulhanek et al. | |
| 2008/0105434 | A1 | 5/2008 | Orbell et al. | |
| 2008/0251257 | A1 | 10/2008 | Leuchtenberg | |
| 2009/0057021 | A1 | 3/2009 | Williams | |
| 2009/0101351 | A1 | 4/2009 | Hannegan | |
| 2009/0139724 | A1 * | 6/2009 | Gray et al. | 166/345 |
| 2010/0018715 | A1 | 1/2010 | Orbell et al. | |
| 2010/0175882 | A1 | 7/2010 | Bailey et al. | |
| 2011/0024195 | A1 | 2/2011 | Hoyer et al. | |
| 2011/0108282 | A1 | 5/2011 | Kozicz et al. | |
| 2011/0127040 | A1 | 6/2011 | Humphreys | |
| 2011/0168392 | A1 | 7/2011 | Bailey et al. | |
| 2012/0125633 | A1 | 5/2012 | Linde et al. | |
| 2012/0305267 | A1 | 12/2012 | Steele | |

FOREIGN PATENT DOCUMENTS

| | | | |
|---|---|---|---|
| EP | 2216498 | A2 | 8/2010 |
| EP | 2378056 | A2 | 4/2011 |
| GB | 2478119 | A | 8/2011 |
| WO | 2007008085 | A1 | 1/2007 |
| WO | 2008120025 | A2 | 10/2008 |
| WO | 2008133523 | A1 | 11/2008 |
| WO | 2009017418 | A1 | 11/2008 |
| WO | 2011104279 | A2 | 9/2011 |

OTHER PUBLICATIONS

Weatherford; "Weatherford Model 7800 Rotating Control Device", Article No. 4593.00, dated 2007, 5 pages.
Weatherford; "Model 7875 Rotating control Device", Article No. 4594.01, dated 2010, 4 pages.
Baker Hughes; "Sand Control Systems", Completions and Production, 30264T, dated 2010, 174 pages.
Don Hannegan; "Offshore Drilling Hazard Mitigation: Controlled Pressure Drilling Redefines what is Drillable", Managed Pressure Drilling/Drilling Contractor article, dated Jan./Feb. 2009, 4 pages.
Halliburton; "FS2 Fluid Loss Isolation Barrier Valve", Subsurface Flow Control Systems article, received Sep. 26, 2011, 2 pages.
Halliburton; "Tubing Control Valve", Figure 12: DOT Tubing Control Valve, dated Mar. 15, 2011, 2 pages.
Halliburton; "IB Series Mechanical Fluid Loss Isolation Barrier Valve", H06472, dated Sep. 2010, 2 pages.
Halliburton; "Isolation Barrier Valves", H07542, dated Jun. 2010, 4 pages.
Halliburton; "Perforating Solutions" Company article, recieved Dec. 2, 2011, 217 Pages.
Halliburton; "Magnumdisk Single and Dual Ceramic Disk Assemblies—Universal", Basic design and maintenance instructions, No. 12PCD00000, dated Jun. 17, 2011, 19 pages.
Smith Services; "Hold 2500 Rotating Control Device", product brochure, article No. ss-04-0055, dated 2004, 4 pages.
Halliburton; "LA0 Liquid Spring-Actuated Anvil Plugging System", Subsurface Flow Control Systems article, received Sep. 26, 2011, 2 pages.
Magnum Oil Tools International; "TCP Systems", Tubing conveyed perforating tools & accessories catalog, received Aug. 14, 2011, 23 pages.
Magnum Oil Tools International; "Magnumdisk", Frangible knock-out isolation subs catalog, received Sep. 25, 2011, 10 pages.
Magnum Oil Tools International; "Dual Magnumdisk", online article, dated 2011, 1 page.
Smith Services; "Marine Riser RCD", company presentation, dated Jul. 2009, 18 pages.
Schlumberger; "Fortress: Isolation Valve", Article 11-CO-0134, dated 2011, 2 pages.
Schlumberger; "Fortress: Isolation Valve", Company catalog 11-CO-0195, dated 2011, 3 pages.
Office Action issued Apr. 9, 2013 for U.S. Appl. No. 13/300,320, 13 pages.
Office Action issued Jul. 24, 2013 for U.S. Appl. No. 13/300,320, 16 pages.
Office Action issued Oct. 3, 2013 for U.S. Appl. No. 13/300,320, 11 pages.
Canadian Office Action issued Mar. 27, 2014 for CA Patent Application No. 2813732, 2 pages.
Office Action issued May 20, 2014 for U.S. Appl. No. 13/300,335, 23 pages.
Chinese Office Action issued May 22, 2014 for CN Patent Application No. 201080070240.9, 9 pages.
International Search Report with Written Opinion issued Aug. 19, 2011 for PCT Patent Application No. PCT/US10/057540, 11 pages.
International Search Report with Written Opinion issued Aug. 19, 2011 for PCT Patent Application No. PCT/US10/057539, 12 pages.
International Search Report with Written Opinion issued Sep. 29, 2011 for PCT Patent Application No. PCT/US11/28384, 11 pages.
Weatherford; "DDV Downhole Deployment Valve", Informational Article 335.01, dated 2005-2010, 4 pages.
Weatherford; "Managed Pressure Drilling, Downhole Deployment Valve Enable Drilling of Big-Bore Gas Wells in Sumatra", Informational Article 2831.03, dated 2007-2010, 2 pages.
Second Office Action dated Jan. 22, 2015, issued in corresponding Chinese patent application No. 201080070240.9, 9 pgs.

* cited by examiner

REMOTE OPERATION OF A ROTATING CONTROL DEVICE BEARING CLAMP

CROSS-REFERENCE TO RELATED APPLICATION

This application claims the benefit under 35 USC §119 of the filing date of International Application Serial No. PCT/US10/57540, filed 20 Nov. 2010. The entire disclosure of this prior application is incorporated herein by this reference.

BACKGROUND

The present disclosure relates generally to equipment utilized and operations performed in conjunction with a subterranean well and, in an embodiment described herein, more particularly provides for remote operation of a rotating control device bearing clamp.

A conventional rotating control device may require human activity in close proximity thereto, in order to maintain or replace bearings, seals, etc. of the rotating control device. It can be hazardous for a human to be in close proximity to a rotating control device, for example, if the rotating control device is used with a floating rig.

Therefore, it will be appreciated that improvements are needed in the art of constructing rotating control devices. These improvements would be useful whether the rotating control devices are used with offshore or land-based rigs.

DETAILED DESCRIPTION

Figure 1:
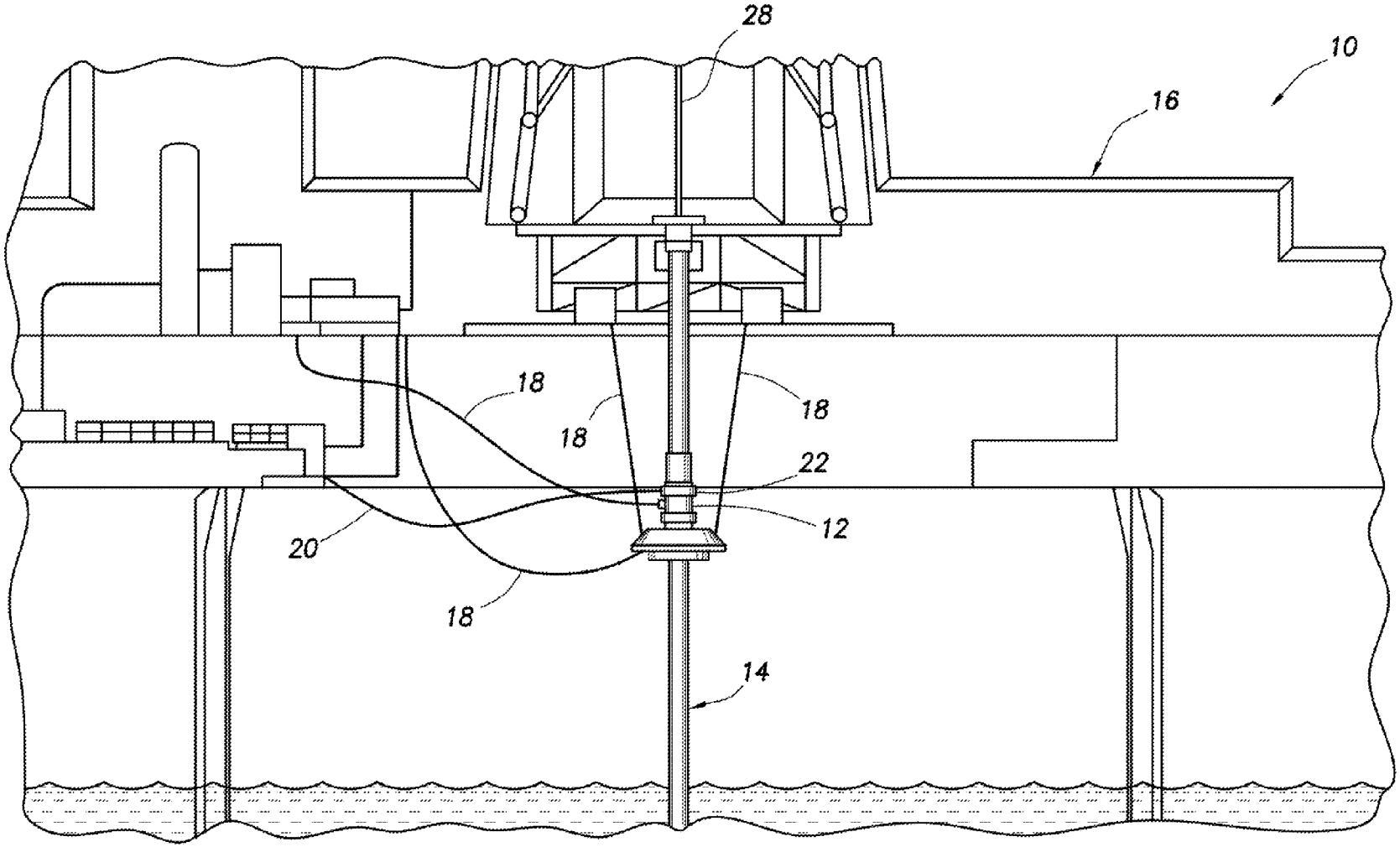
FIG. 1 is a schematic view of a well system and associated method which embody principles of the present disclosure.

Representatively illustrated in FIG. 1 is a well system 10 and associated method which can embody principles of the present disclosure. In the system 10, a rotating control device (RCD) 12 is connected at an upper end of a riser assembly 14. The riser assembly 14 is suspended from a floating rig 16.

It will be readily appreciated by those skilled in the art that the area (known as the "moon pool") surrounding the top of the riser assembly 14 is a relatively hazardous area. For example, the rig 16 may heave due to wave action, multiple lines and cables 18 may be swinging about, etc. Therefore, it is desirable to reduce or eliminate any human activity in this area.

Seals and bearings in a rotating control device (such as the RCD 12) may need to be maintained or replaced, and so one important feature of the RCD depicted in FIG. 1 is that its clamp device 22 can be unclamped and clamped without requiring human activity in the moon pool area of the rig 16. Instead, fluid pressure lines 20 are used to apply pressure to the clamp device 22, in order to clamp and unclamp the device (as described more fully below).

Figure 2:
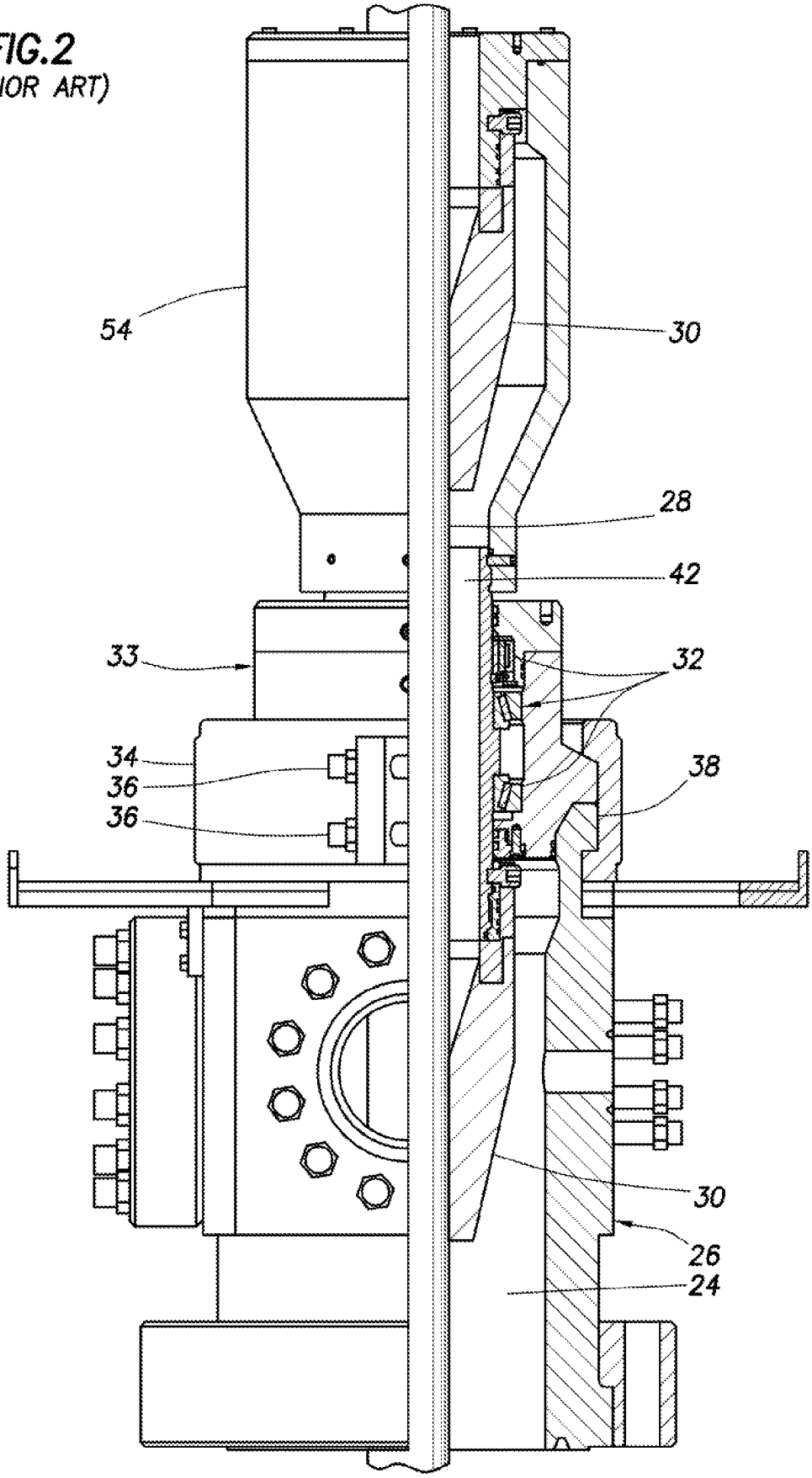
FIG.2 (PRIOR ART)
FIG. 2 is a partially cross-sectional view of a prior art rotating control device.

Referring additionally now to FIG. 2, a prior art rotating control device is representatively illustrated. The rotating control device depicted in FIG. 2 is used as an example of a type of rotating control device which can be improved using the principles of this disclosure. However, it should be clearly understood that other types of rotating control devices can incorporate the principles of this disclosure.

Rotating control devices are also known by the terms "rotating control head," "rotating blowout preventer" and "rotating diverter" and "RCD." A rotating control device is used to seal off an annulus 24 formed radially between a body 26 of the rotating control device and a tubular string 28 (such as a drill string) positioned within a flow passage 42 which extends longitudinally through the rotating control device.

For this purpose, the rotating control device includes one or more annular seals 30. To permit the seals 30 to rotate as the tubular string 28 rotates, bearing assemblies 32 are provided in a bearing housing assembly 33. The bearing housing assembly 33 provides a sealed rotational interface between the body 26 of the rotating control device, and its annular seal(s) 30.

A clamp 34 releasably secures the housing assembly 33 (with the bearing assembly 32 and seals 30 therein) to the body 26, so that the bearing assembly and seals can be removed from the body for maintenance or replacement. However, in the prior art configuration of FIG. 2, threaded bolts 36 are used to secure ends of the clamp 34, and so human activity in the area adjacent the rotating control device (e.g., in the moon pool) is needed to unbolt the ends of the clamp whenever the bearing assembly 32 and seals 30 are to be removed from the body 26. This limits the acceptability of the FIG. 2 rotating control device for use with land rigs, floating rigs, other types of offshore rigs, etc.

Figure 3A:
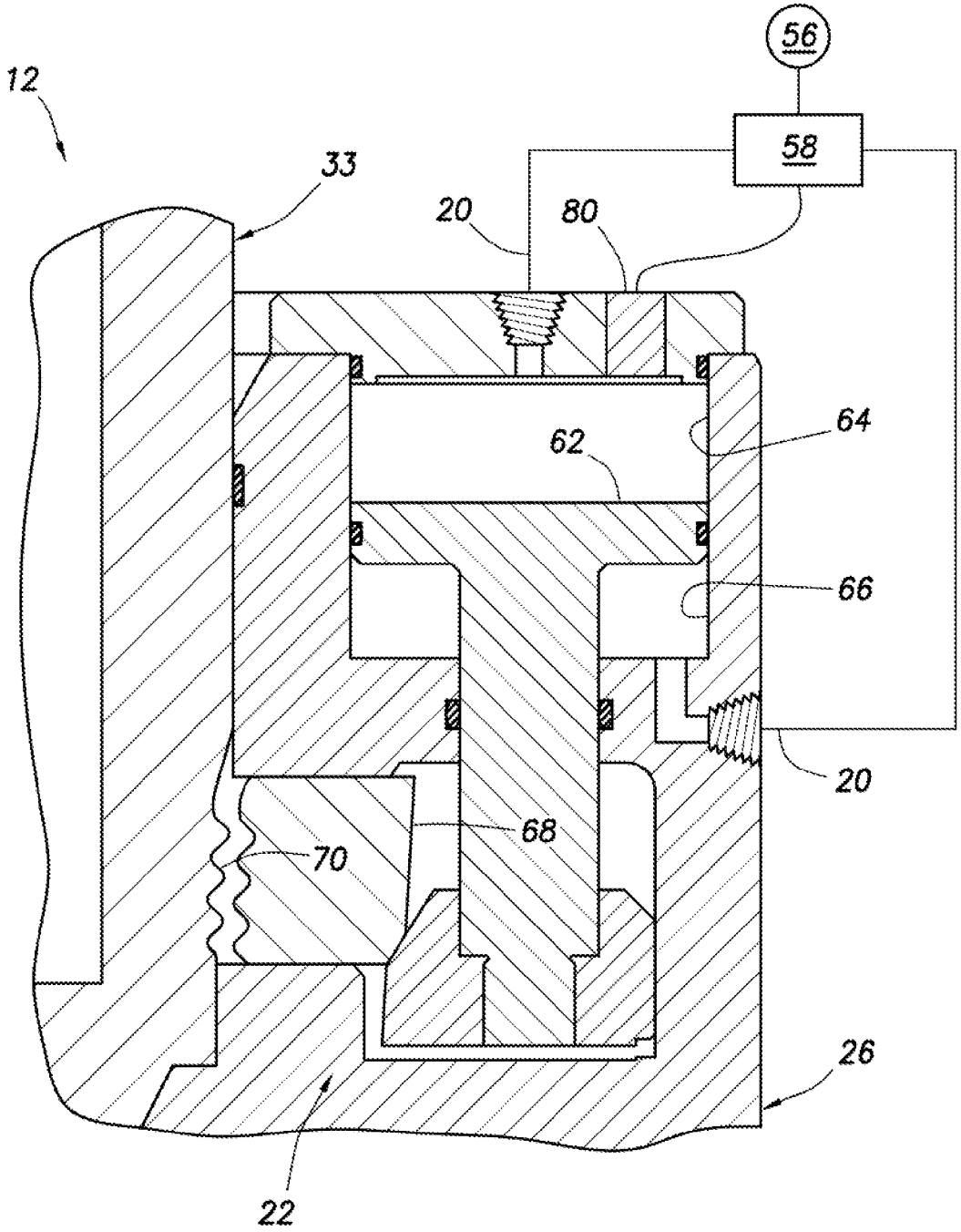
FIGS. 3A & B are schematic partially cross-sectional views of an improvement to the rotating control device, the improvement comprising a clamp device and embodying principles of this disclosure, and the clamp device being shown in unclamped and clamped arrangements.

Referring additionally now to FIGS. 3A & B, one example of the remotely operable clamp device 22 used in the improved rotating control device 12 of FIG. 1 is representatively illustrated in respective unclamped and clamped arrangements. In this example, the clamp device 22 includes a piston 62 which displaces in response to a pressure differential between chambers 64, 66 on opposite sides of the piston. A series of circumferentially distributed dogs, lugs or clamp sections 68 carried on or otherwise attached to the body 26 are displaced radially into, or out of, engagement with a complementarily shaped profile 70 on the housing assembly 33 when the piston 62 displaces upward or downward, respectively, as viewed in FIGS. 3A & B.

The chambers 64, 66 may be connected via lines 20 to a pressure source 56 (such as a pump, compressor, accumulator, pressurized gas chamber, etc.) and a pressure control system 58. Pressure is delivered to the chambers 64, 66 from the pressure source 56 under control of the control system 58.

For example, when it is desired to unclamp the clamp device 22, the control system 58 may cause the pressure source 56 to deliver a pressurized fluid flow to one of the lines 20 (with fluid being returned via the other of the lines), in order to cause the piston 62 to displace in one direction. When it is desired to clamp the clamp device 22, the control system 58 may cause the pressure source 56 to deliver a pressurized fluid flow to another of the lines 20 (with fluid being returned via the first line), in order to cause the piston 62 to displace in an opposite direction. The control system 58 could comprise a manually operated four-way, three-position valve, or a more sophisticated computer controlled programmable logic controller (PLC) and valve manifold, etc., interconnected between the pressure source 56 and the clamp device 22.

Figure 3B:
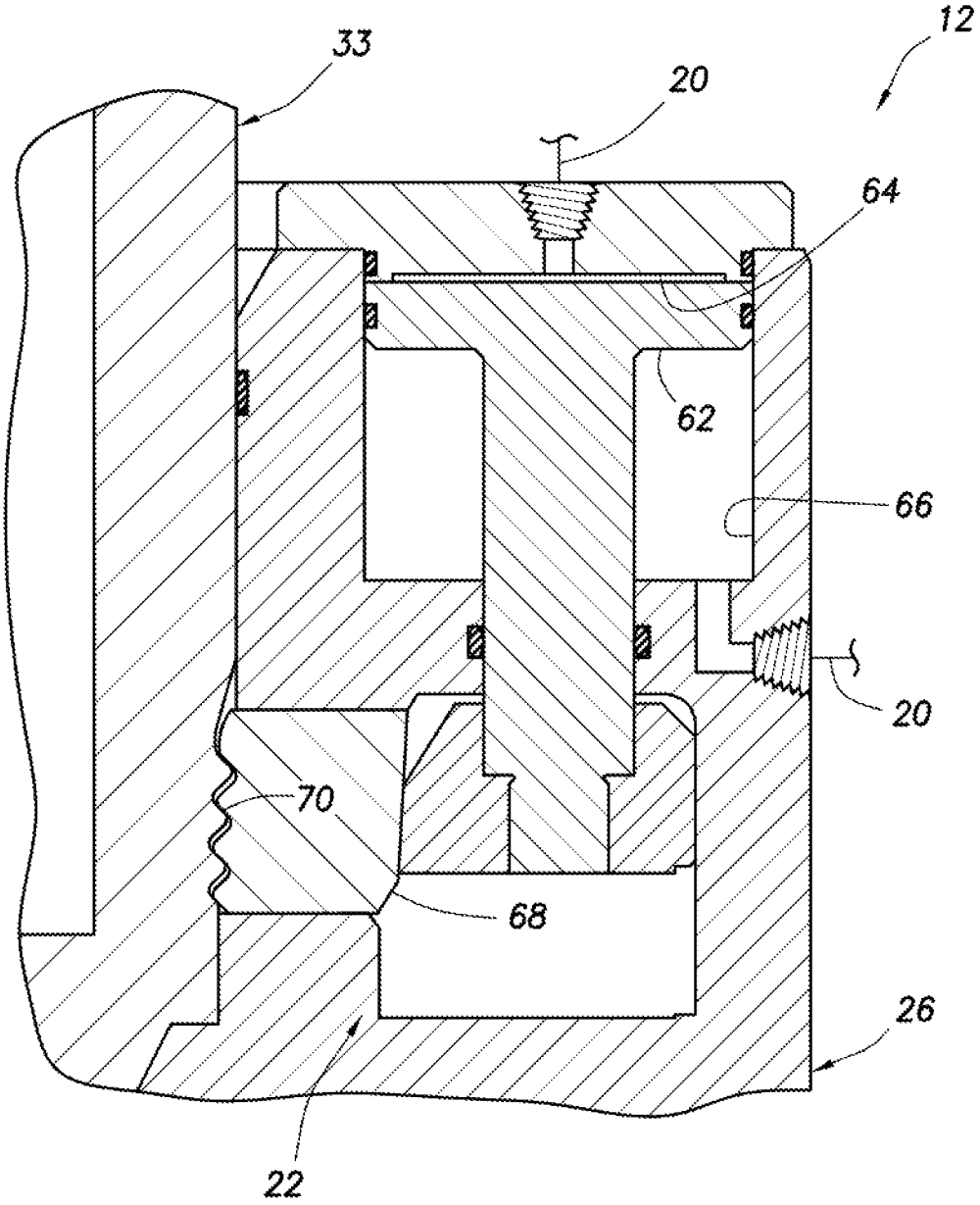

The control system 58 can control whether a pressure differential is applied from the chamber 64 to the chamber 66 (as depicted in FIG. 3A) to displace the piston 62 to its unclamped position, or the pressure differential is applied from the chamber 66 to the chamber 64 (as depicted in FIG. 3B) to displace the piston to its clamped position. A middle position of a three-position valve could be used to prevent inadvertent displacement of the piston 62 after it has been displaced to its clamped or unclamped position. Of course, other types of valves, and other means may be provided for controlling displacement of the piston 62, in keeping with the principles of this disclosure.

The control system 58 is preferably remotely located relative to the rotating control device 12. At least, any human interface with the control system 58 is preferably remotely located from the rotating control device 12, so that human presence near the rotating control device is not needed for the clamping and unclamping processes.

A position sensor 80 (such as, a visual, mechanical, electrical, proximity, displacement, magnetic, position switch, or other type of sensor) may be used to monitor the position of the piston 62 or other component(s) of the clamp device 22 (such as, the clamp sections 68). In this manner, an operator can confirm whether the clamp device 22 is in its clamped, unclamped or other positions.

Figure 4B:
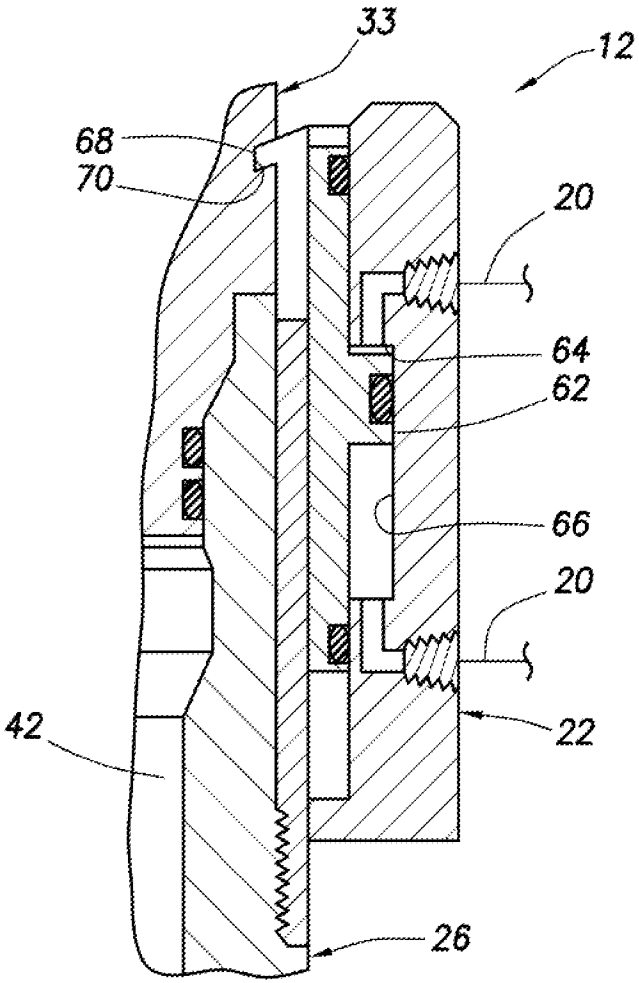
FIGS. 4A & B are schematic partially cross-sectional views of another configuration of the clamp device in unclamped and clamped arrangements.
Figure 4A:
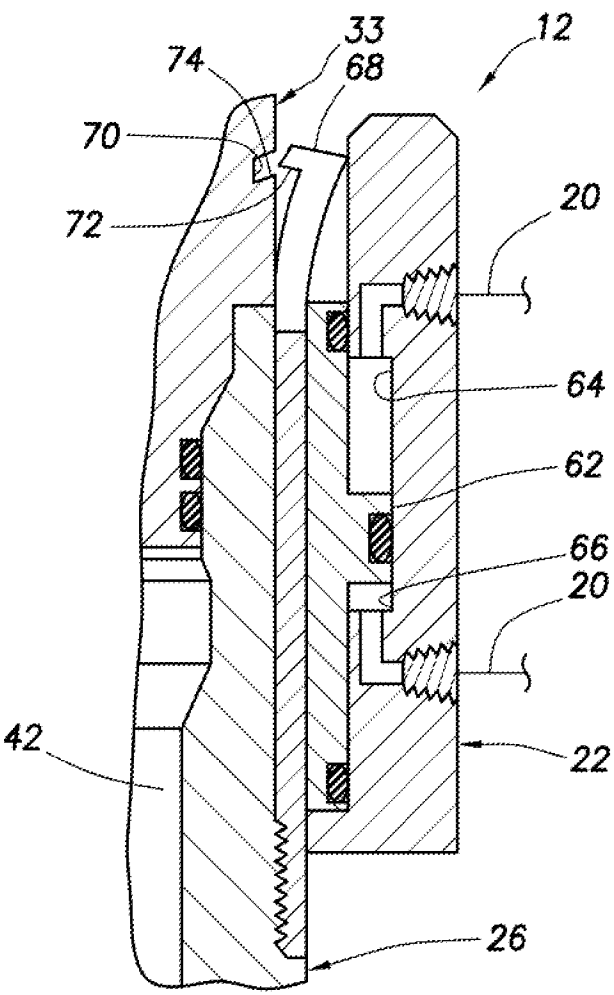

Referring additionally now to FIGS. 4A & B, another configuration of the clamp device 22 is representatively illustrated in respective unclamped and clamped arrangements. This configuration is similar in some respects to the configuration of FIGS. 3A & B, in that pressure differentials across the piston 62 is used to displace the piston to its clamped and unclamped positions.

However, the configuration of FIGS. 4A & B utilizes clamp sections 68 which are in the form of collet fingers. The collet fingers are pre-bent into a radially spread-apart arrangement (as depicted in FIG. 4A), so that, when the piston 62 is in its unclamped position, the clamp sections 68 will be disengaged from the profile 70 on the housing assembly 33, thereby allowing the housing assembly to be withdrawn from, or installed into, the body 26.

When the piston 62 is displaced to its clamped position (as depicted in FIG. 4B), the clamp sections 68 are displaced radially inward into engagement with the profile 70, thereby preventing the housing assembly 33 from being withdrawn from the body 26. Preferably, lower surfaces 72 of the clamp sections 68, and a lower surface 74 of the profile 70 are inclined upward somewhat in a radially outward direction, so that the clamp sections will be prevented from disengaging from the profile if the rotating control device 12 is internally pressurized, no matter whether the piston 62 is in its upper or lower position.

As with the configuration of FIGS. 3A & B, the chambers 64, 66 in the configuration of FIGS. 4A & B may be connected via the lines 20 to the pressure source 56 and control system 58 described above. Another difference in the FIGS. 4A & B configuration is that the piston 62 is annular-shaped (e.g., so that it encircles the flow passage 42 and other components of the rotating control device 12).

Although the profiles 70 in the configurations of FIGS. 3A-4B are depicted as being concave recesses formed in the housing assembly 33, the profiles could instead be convex projections formed on the housing assembly, and/or the profiles could be formed on the body 26, whether or not the profiles are also formed on the housing assembly.

Figure 5A:
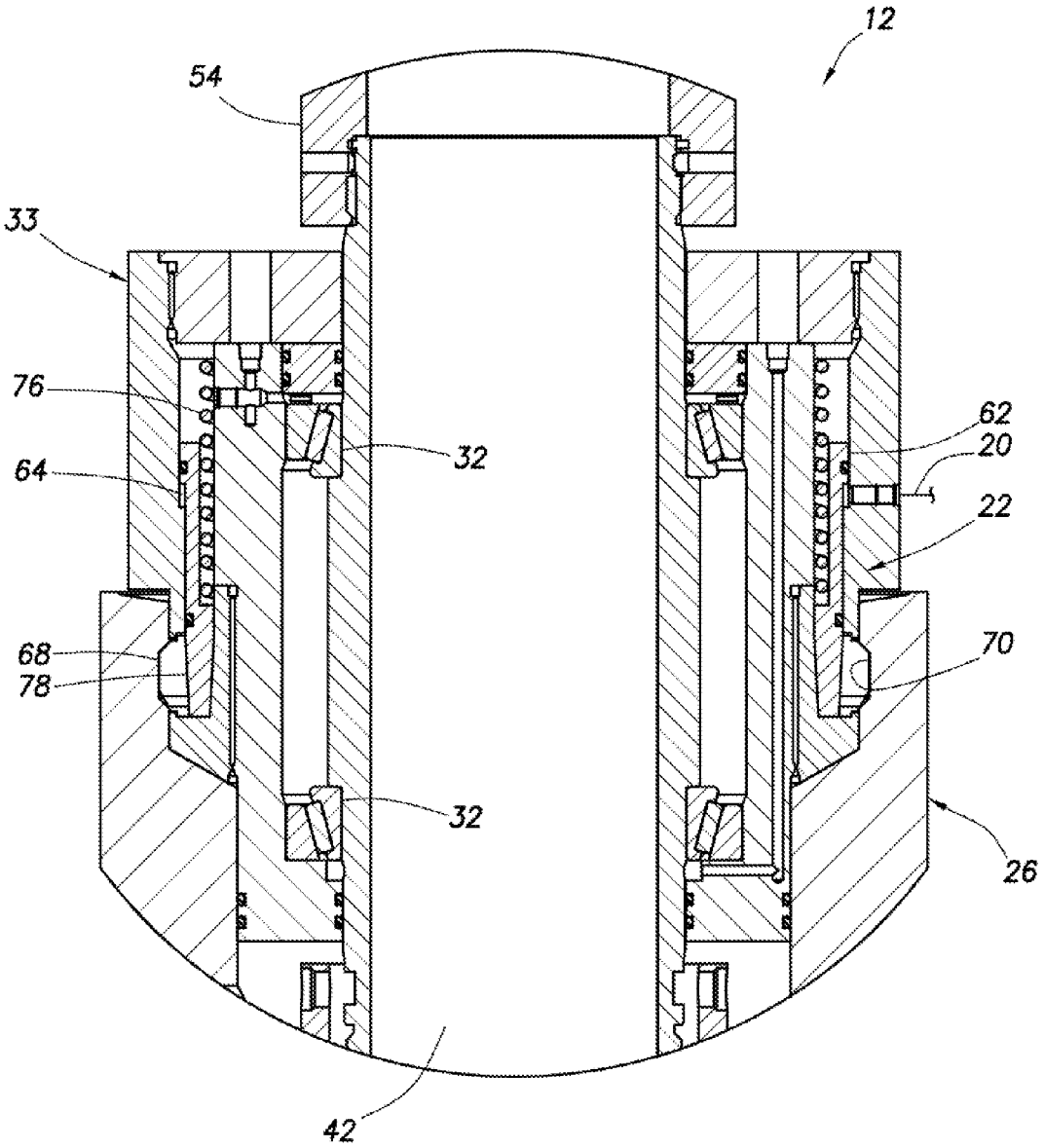
FIGS. 5A-C are schematic partially cross-sectional views of yet another configuration of the clamp device in clamped, unclamped and separated arrangements.
Figure 5B:
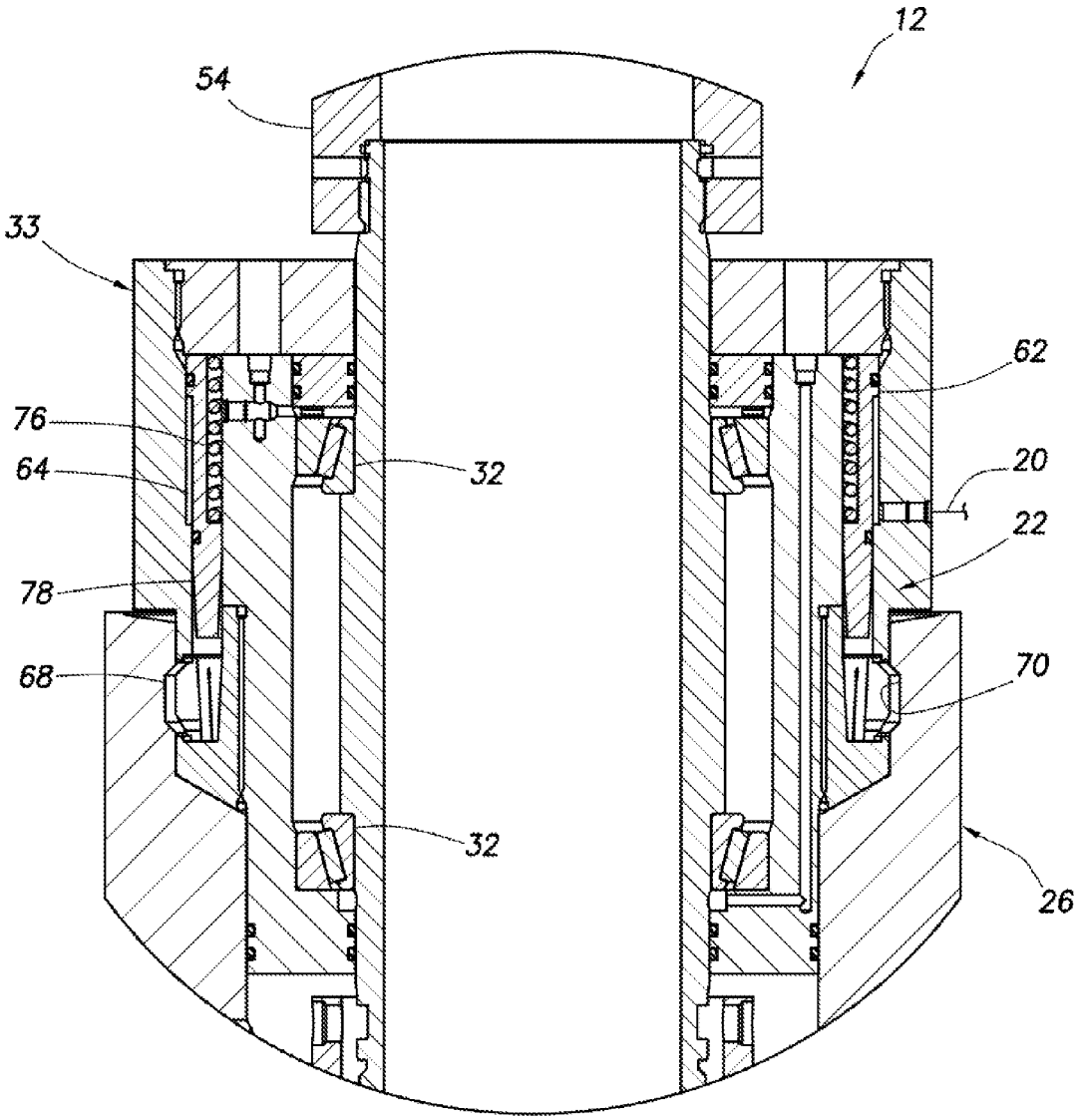
Figure 5C:
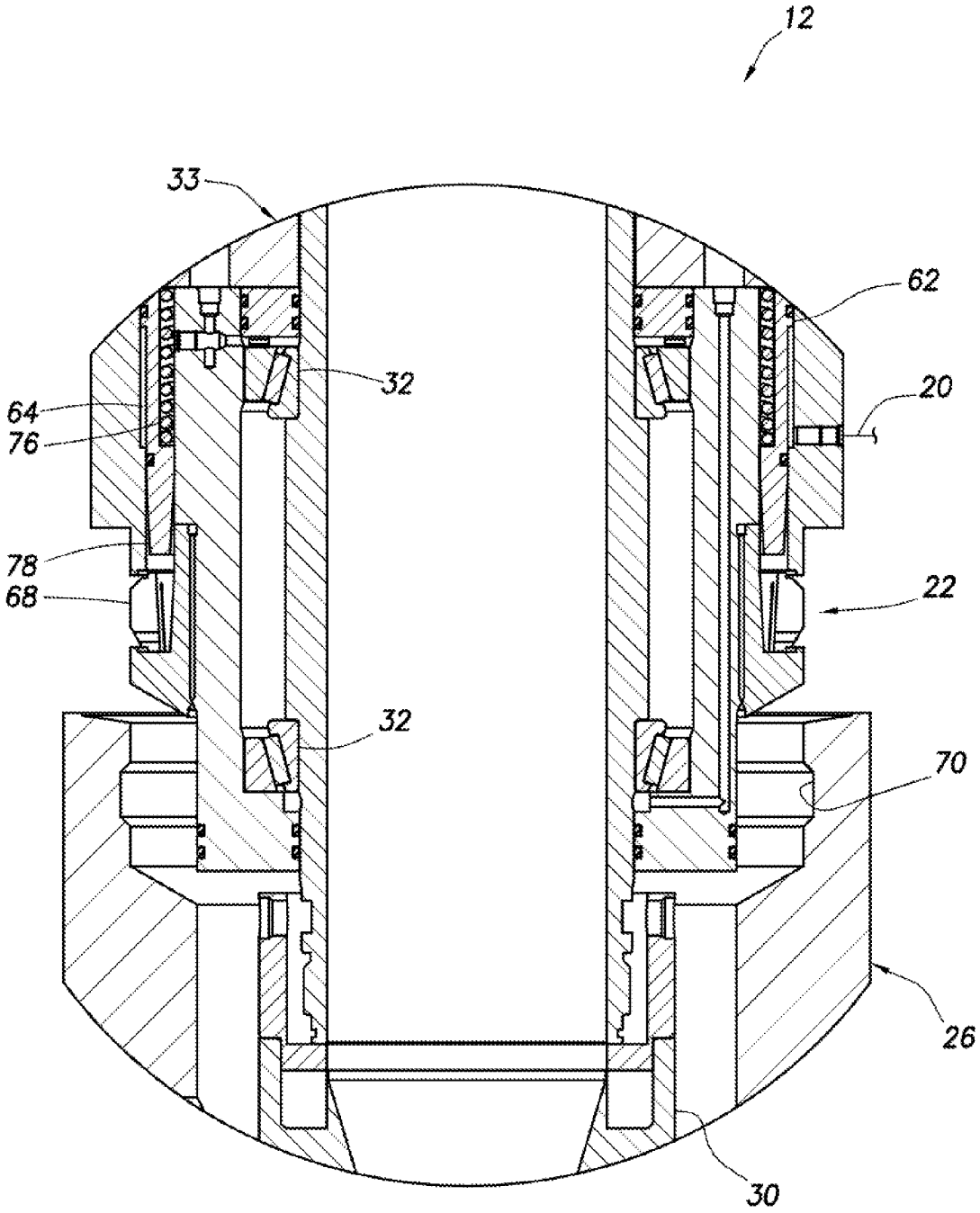

Referring additionally now to FIGS. 5A-C, another configuration of the clamp device 22 is representatively illustrated in respective clamped, unclamped and separated arrangements. The configuration of FIGS. 5A-C is similar in many respects to the configurations of FIGS. 3A-4B.

However, in the configuration of FIGS. 5A-C, the clamp sections 68 are supported radially outward into engagement with the profile 70 formed internally in the body 26 of the rotating control device 12 when the bearing housing assembly 33 is clamped to the body, as depicted in FIG. 5A. The piston 62 is maintained by a biasing device 76 in a downward position in which a lower inclined surface 78 on the piston radially outwardly supports the clamp sections 68.

When it is desired to unclamp the bearing housing assembly 33, pressure is applied to the chamber 64 via the line 20, thereby displacing the piston 62 upward against the biasing force exerted by the biasing device 76, as depicted in FIG. 5B. In this upwardly displaced position of the piston 62, the clamp sections 68 are permitted to displace radially inward, and out of engagement with the profile 70. The bearing housing assembly 33 can now be separated from the body 26, as depicted in FIG. 5C.

Figure 6:
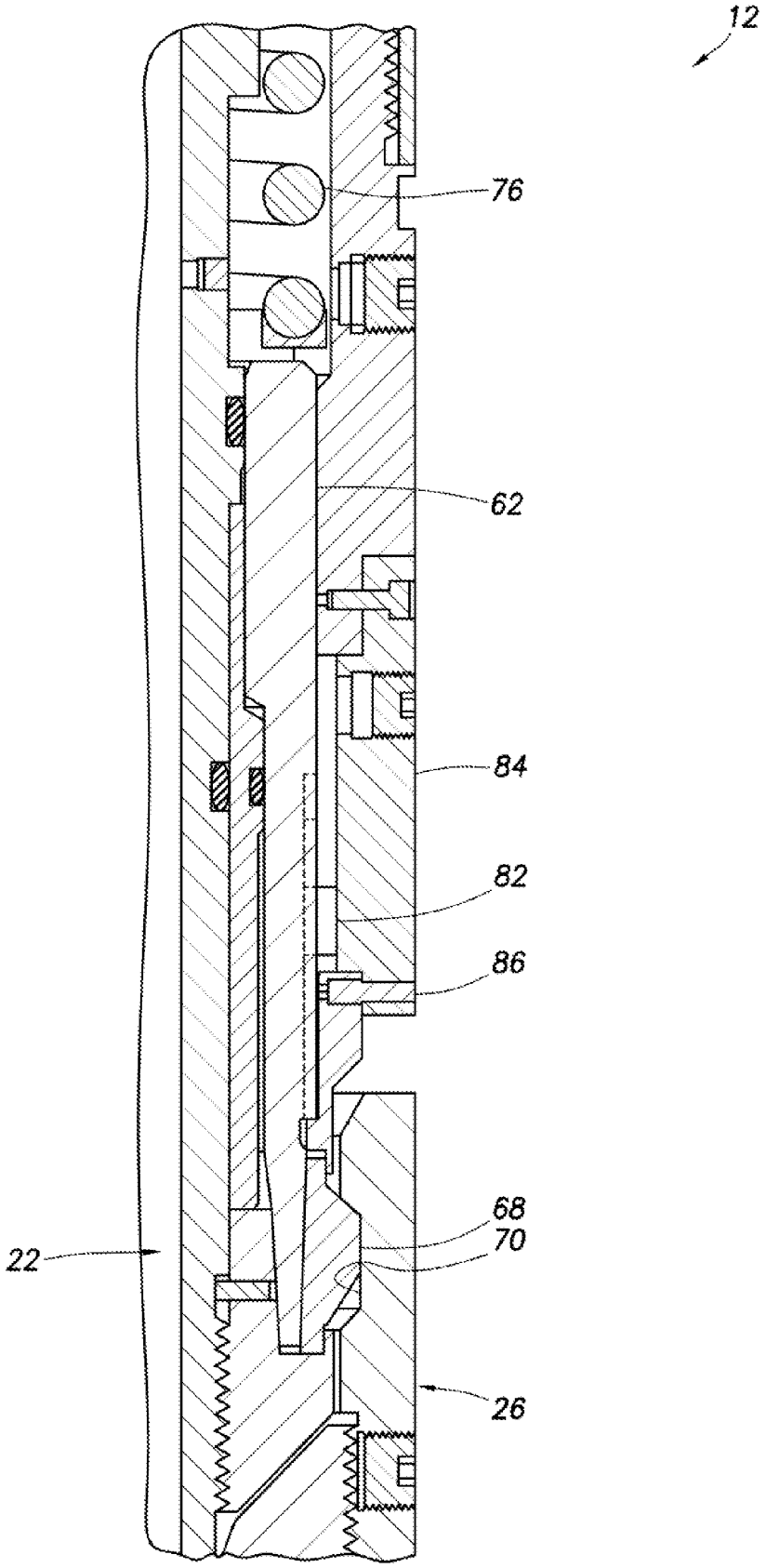
FIG. 6 is a schematic partially cross-sectional view of yet another configuration of the clamp device in a clamped arrangement.

Another configuration of the clamp device 22 is representatively illustrated in FIG. 6. The configuration of FIG. 6 is similar in many respects to the configuration of FIGS. 5A-C, however, in the configuration of FIG. 6, the piston 62 can be displaced mechanically from its clamped position using an unclamping device 82 (instead of a pressure differential across the piston). The unclamping device 82 may be used to manually unclamp the clamping device 22, in situations where the pressure source 56 and/or control system 58 is unavailable or inoperative.

In the example of FIG. 6, the unclamping device 82 is threaded onto the piston 62 and is engaged via longitudinal splines with an outer sleeve 84. To displace the piston 62 to its unclamped position, the outer sleeve 84 is rotated (upon breaking shear pins 86), thereby rotating the device 82 and biasing the piston upward against the biasing force exerted by the biasing device 76 (due to the threaded engagement of the device with the piston).

Other types of unclamping devices may be used, if desired. For example, a threaded fastener (such as a bolt or threaded rod, etc.) could be threaded into the piston to displace the piston and compress the biasing device 76.

Note that the clamp sections 68 of FIGS. 5A-C are sections of a single continuous ring, which is sliced partially through from alternating upper and lower sides, thereby making the ring expandable in a radial direction. However, the clamp sections 68 could be provided as collets, dogs, lugs, keys, or in any other form, if desired.

The line 20 in the configuration of FIGS. 5A-C may be connected to the pressure source 56 and control system 58 described above. Only a single line 20 is used in this configuration, since the biasing device 76 is capable of displacing the piston 62 in one direction, but multiple lines could be used if desired to produce pressure differentials across the piston, as described for the other examples above.

Although the RCD 12 in its various configurations is described above as being used in conjunction with the floating rig 16, it should be clearly understood that the RCD can be used with any types of rigs (e.g., on a drill ship, semi-submersible, jack-up, tension leg, land-based, etc., rigs) in keeping with the principles of this disclosure.

Although separate examples of the clamp device 22 are described in detail above, it should be understood that any of the features (such as the position sensor 80 of FIG. 3A) of any of the described configurations may be used with any of the other configurations. For example, the clamp sections 68 of the FIGS. 5A-C configuration could be used in the FIGS. 3A & B configuration, the piston 62 of the FIGS. 4A & B configuration could be used in the FIGS. 5A-C configuration, etc.

The piston 62, clamp sections 68, biasing device 76 and/or other components of the clamp device 22 can be carried on the housing assembly 33 (as in the example of FIGS. 5A-C) and/or the body 26 (as in the examples of FIGS. 3A-4B), and the profile 70 can be formed on the housing assembly and/or the body in any rotating control device incorporating principles of this disclosure.

It may now be fully appreciated that the above disclosure provides advancements to the art of operating a clamp device on a rotating control device. The clamp device 22 can be remotely operated, to thereby permit removal and/or installation of the bearing assembly 32 and seals 30, without requiring human activity in close proximity to the RCD 12.

The above disclosure provides to the art a rotating control device 12 which can include a housing assembly 33, a body 26 and a clamp device 22 which releasably secures the housing assembly 33 to the body 26, the clamp device 22 including a piston 62 which radially displaces a clamp section 68.

The piston 62 may radially displace the clamp section 68 into latched engagement with a profile 70.

The clamp section 68 can comprise a continuous ring (as depicted in FIGS. 5A-6), multiple collets (as depicted in FIGS. 4A & B) and/or multiple lugs (as depicted in FIGS. 3A & B).

The piston 62 may be annular shaped. The piston 62 may encircle a flow passage 42 which extends longitudinally through the rotating control device 12.

The piston 62 may displace longitudinally when the clamp section 68 displaces radially.

The rotating control device 12 can also include an unclamping device 82 which displaces the piston 62 without a pressure differential being created across the piston 62. The unclamping device 82 may threadedly engage the piston 62.

The rotating control device 12 can also include a position sensor 80 which senses a position of the piston 62.

The clamp section 68 can be locked into engagement with a profile 70 when the body 26 is internally pressurized.

The above disclosure also provides to the art a well system 10 which can comprise a rotating control device 12 which includes at least one seal 30 which seals off an annulus 24 between a body 26 of the rotating control device 12 and a tubular string 28 which extends longitudinally through the rotating control device 12. The rotating control device 12 can also include a piston 62 which displaces longitudinally and selectively clamps and unclamps a housing assembly 33 to the body 26.

It is to be understood that the various embodiments of the present disclosure described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of the present disclosure. Accordingly, the foregoing detailed description is to be clearly understood as being given by way of illustration and example only, the spirit and scope of the present invention being limited solely by the appended claims and their equivalents.

What is claimed is:

1. A rotating control device, comprising:

a housing assembly;

a body;

a clamp device configured to releasably secure the housing assembly to the body, the clamp device including a piston configured to radially displace a clamp section; and an unclamping device coupled between the piston and a sleeve, the unclamping device configured to radially displace the clamp section without a pressure differential being created across the piston, the sleeve configured to displace the unclamping device.

2. The rotating control device of claim 1, wherein the piston is configured to radially displace the clamp section into latched engagement with a profile.

3. The rotating control device of claim 1, wherein the clamp section comprises a continuous ring.

4. The rotating control device of claim 1, wherein the clamp section comprises multiple collets.

5. The rotating control device of claim 1, wherein the clamp section comprises multiple lugs.

6. The rotating control device of claim 1, wherein the piston is annular shaped.

7. The rotating control device of claim 1, wherein the piston is arranged to encircle a flow passage which extends longitudinally through the rotating control device.

8. The rotating control device of claim 7, wherein the piston is configured to displace longitudinally when the clamp section is displaced radially.

9. The rotating control device of claim 1, wherein the unclamping device is configured to threadedly engage the piston.

10. The rotating control device of claim 1, further comprising a position sensor configured to sense a position of the piston.

11. The rotating control device of claim 1, wherein the clamp section is locked into engagement with a profile when the body is internally pressurized.

12. A well system, comprising:

a rotating control device including:

at least one seal which seals off an annulus between a body of the rotating control device and a tubular string extending longitudinally through the rotating control device;

a piston configured to displace longitudinally and selectively clamp and unclamp a housing assembly to the body, wherein longitudinal displacement of the piston is configured to radially displace a clamp section; and an unclamping device configured to radially displace the clamp section without a pressure differential being created across the piston, the unclamping device coupled between the piston and a sleeve configured to displace the unclamping device.

13. The well system of claim 12, wherein the piston is configured to radially displace the clamp section into latched engagement with a profile.

14. The well system of claim 12, wherein the clamp section comprises a continuous ring.

15. The well system of claim 12, wherein the clamp section comprises multiple collets.

16. The well system of claim 12, wherein the clamp section comprises multiple lugs.

17. The well system of claim 12, wherein the clamp section is configured to lock into engagement with a profile when the body is internally pressurized.

18. The well system of claim 12, wherein the piston is annular shaped.

19. The well system of claim 12, wherein the piston is arranged to encircle a flow passage which extending longitudinally through the rotating control device.

20. The well system of claim 12, wherein the unclamping device is configured to threadedly engage the piston.

21. The well system of claim 12, further comprising a position sensor configured to sense a position of the piston.

* * * * *